US005184727A

United States Patent [19]

Dickie et al.

[11] Patent Number: 5,184,727

[45] Date of Patent: Feb. 9, 1993

[54] MODULAR INFLATED SUPPORTING STRUCTURE

[75] Inventors: Robert G. Dickie, Newmarket; Brian J. Walters, Sunderland, both of Canada

[73] Assignee: Intepac Technoligies Inc., King City, Canada

[21] Appl. No.: 801,366

[22] Filed: Dec. 2, 1991

[51] Int. Cl.[5] ..... B65D 81/02

[52] U.S. Cl. ..... 206/522; 206/591; 410/119

[58] Field of Search ..... 206/522, 591; 410/119, 410/125; 383/3, 37

[56] References Cited

U.S. PATENT DOCUMENTS

| | | | |
|---|---|---|---|
| 3,398,501 | 8/1968 | Aninger | 206/522 X |
| 3,552,466 | 1/1971 | Fairchilds | 206/522 X |
| 3,889,743 | 6/1975 | Presnick . | |
| 3,987,736 | 10/1976 | Miller | 206/522 X |
| 4,551,379 | 11/1985 | Kerr . | |
| 4,905,835 | 3/1990 | Pivert et al. . | |
| 5,030,501 | 7/1991 | Colvin et al. . | |
| 5,042,663 | 8/1991 | Heinrich | 206/522 |

FOREIGN PATENT DOCUMENTS

| | | | |
|---|---|---|---|
| 0096364 | 12/1983 | European Pat. Off. | 206/522 |
| 2389547 | 1/1979 | France | 206/522 |
| 958500 | 5/1964 | United Kingdom | 206/522 |

*Primary Examiner*—Bryon P. Gehman

*Attorney, Agent, or Firm*—Donald E. Hewson

[57] ABSTRACT

A modular supporting structure for positioning and supporting a product within an outer packing container, is disclosed. The product to be supported has predetermined external dimensions, and the outer packing container forms a chamber of predetermined internal dimensions. The supporting structure is formed from a plurality of modules, each module in turn comprising an air bladder for receiving and retaining air. The air bladder has a first compartment and a second compartment that are in fluid communication one with the other via a restrictive air passage that limits the rate of flow of air therebetween, thus providing physical damping for the product being supported by the modules. There is a connecting portion in the form of a flange, which is attached to the air bladder, that allows the modules to be interconnected one with another. When the modules are connected one to another, a product-receiving socket is formed. The product-receiving socket is shaped to fit the predetermined external dimensions of the product.

17 Claims, 5 Drawing Sheets

FIG. 1
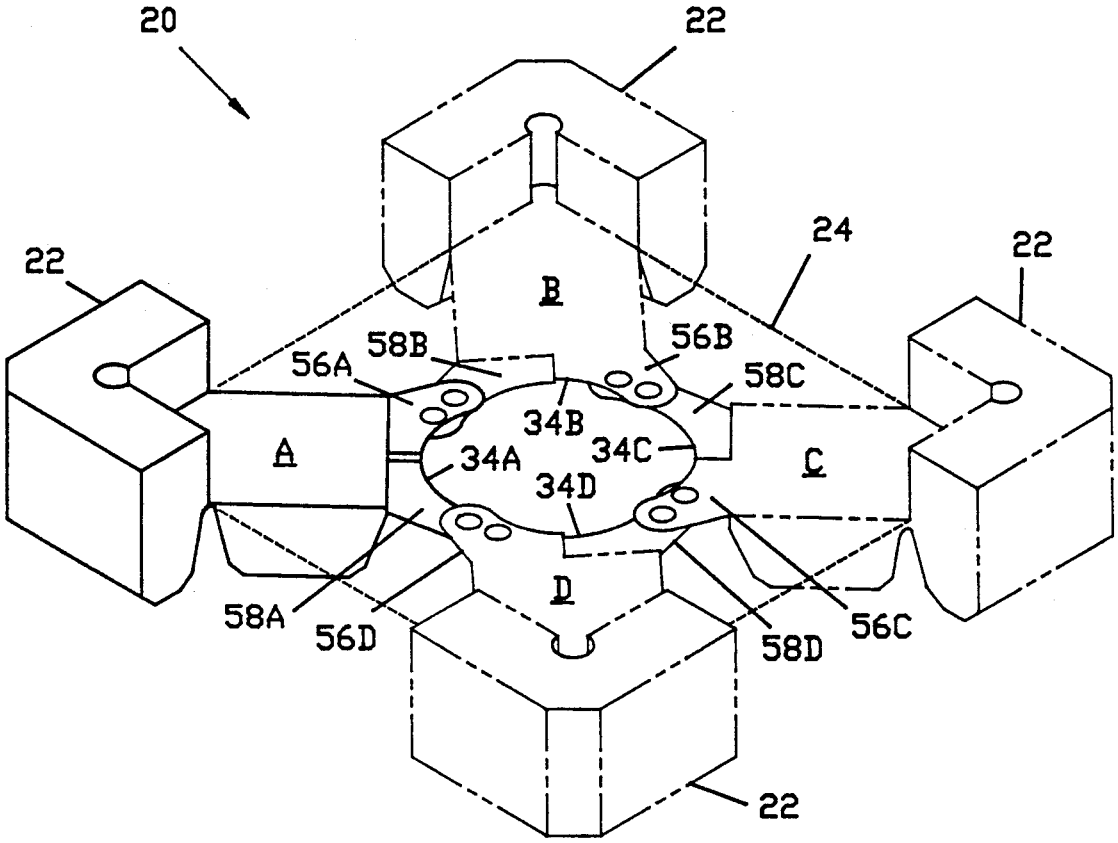
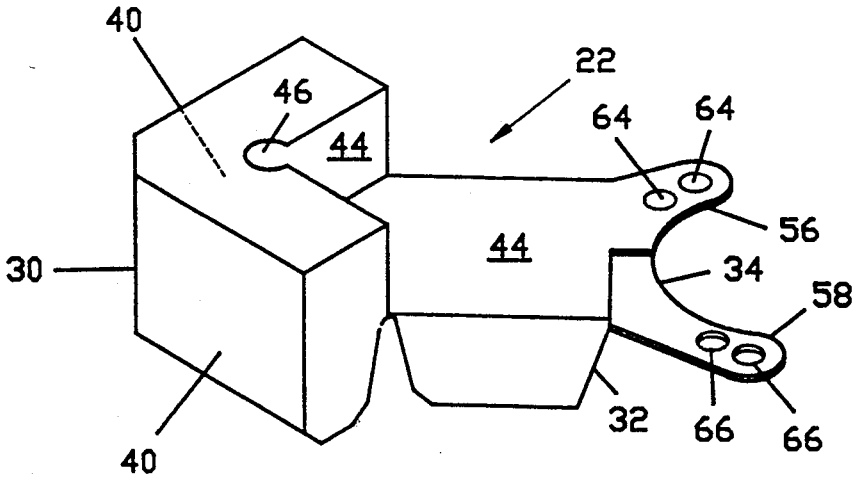
FIG. 2

FIG. 3
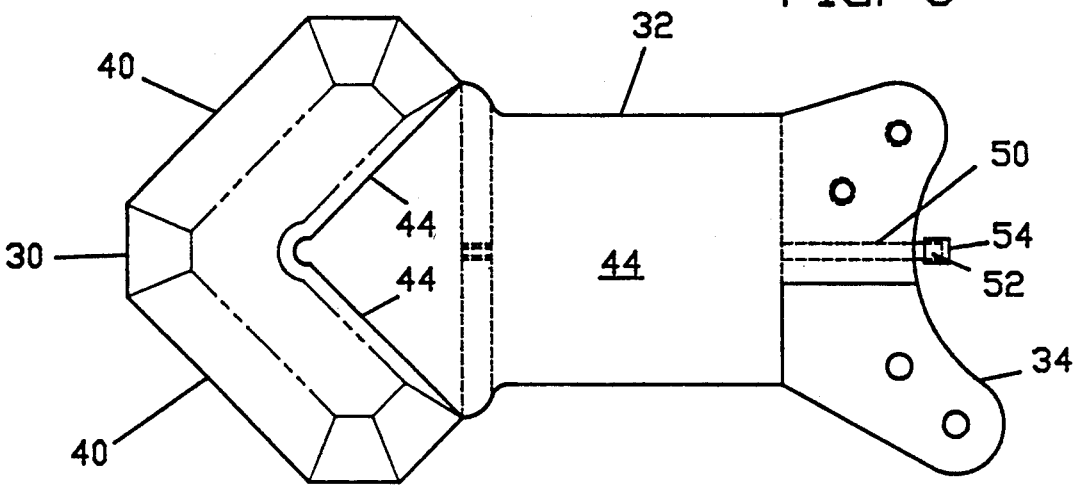
FIG. 4
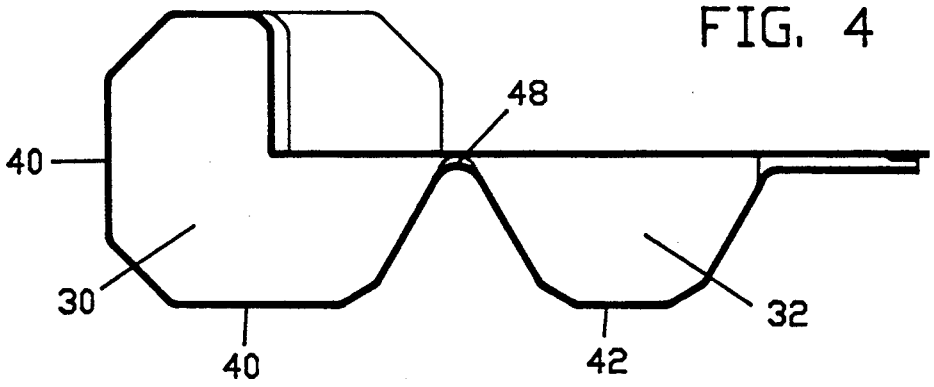
FIG. 5
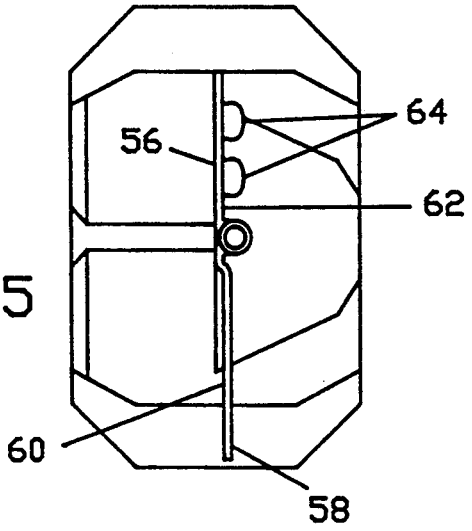
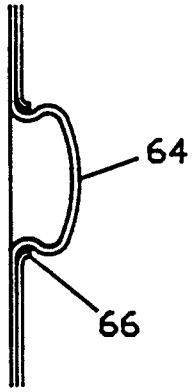
FIG. 6

MODULAR INFLATED SUPPORTING STRUCTURE

FIELD OF THE INVENTION

This invention relates to packing elements and more particularly relates to elements that are used to protect a product packed in a container such as a box. Specifically, the container and the product therein are each of a predetermined size and shape.

BACKGROUND OF THE INVENTION

Many products that are manufactured and ultimately sold for and used by an end user—whether it be a company or an individual—must be shipped at least once from where the product is produced to where the product is stored, consumed or used. In actuality, a product may be shipped several times, such as from the manufacturer to the distributor, to the warehouse, then to a retail store and ultimately to an end user. It is of course necessary that the product be protected during this time of shipping and storage so that it ultimately reaches the end user in an unharmed condition.

A very widely used—and indeed almost universally used—packaging system for protecting products that could be easily damaged during shipping and storage—typically items such as electrical or electronic appliances—consists of a cardboard box with packing material interposed between the product and the inner walls of the cardboard box. The packing material displaces the product from the cardboard box around all sides of the product so that almost any impact on the cardboard box will not directly reach the product. Further, the packing material preferably keeps the product in a fixed relation with respect to the cardboard box so that the product does not move around within the cardboard box. In order to keep the product in fixed relation within the cardboard box, it is necessary that the product fit snugly within the packing material and also that the packing material fit snugly within the cardboard box.

Two types of forces may be encountered by a packed product during shipping and storage. Firstly, there is movement of the cardboard box, which may be quite sudden or severe. This sudden or severe movement would cause the cardboard box to experience related accelerative and decelerative forces. Correspondingly, the product inside must move along with the cardboard box, and if there is no cushioning between the product and the cardboard box, the product would experience roughly the same accelerative and decelerative forces experienced by the cardboard box. Secondly, there are impact forces that can occur as a result of a sudden impact with the cardboard box by another object. Again, the accelerative forces are transmitted through the box to the product and must be cushioned in order to protect the product from potential damage.

In order that forces experienced under various shipping and storage conditions are not transmitted to the product, it is necessary to have some sort of packing material that will deform to some degree in order to absorb the impact forces slowly and evenly over a period of time. This will spread out the absorption of the energy of the impact forces such that the full impact forces will not be transmitted to the product. Resultingly, a smaller force will be transmitted over a longer period of time. The product will not experience as great a force, and therefore will be less likely to be damaged.

PRIOR ART

U.S. Pat. No. 4,905,835, issued to PIVERT et al discloses an Inflatable Cushion Packaging that comprises a flexible inflatable structure having three separate inflatable cushions that are in fluid communication with one another. Two of these structures are used to protect the product in a box. One structure forms the bottom and two opposed sides and the other structure forms the top and the other two opposed sides. This packaging product is inflated to whatever size is necessary, within limits, to snugly pack the product within the box. It is not of a fixed size and therefore is not product specific.

U.S. Pat. No. 3,889,743, issued to PRESNICK discloses Inflatable Insulation for packaging comprising a flexible, collapsible bag structure. The bag structure comprises a pair of flexible thermoplastic bags one inside the other. The bags are inflated, at least partially, to create a "dead air space" that provides physical and thermal insulation for packing. In use, the Inflatable Insulation is placed in a box and the product is then placed within the packaging and the packaging is then inflated. This insulation can accommodate various sizes of products and therefore is not product specific.

U.S. Pat. No. 4,551,379, issued to KERR discloses an Inflatable Packaging Material that is formed from a pair of juxtaposed sheets as a plurality of continuous passages between the two sheets with each of the passages being in limited fluid communication with adjacent passages. The passages are inflatable to provide a shock absorbing facility. The inflatable packaging material disclosed in this patent can be used for packing various sizes of products into various sizes of containers and therefore is not product specific.

U.S. Pat. No. 5,030,501, issued to COLVIN et al discloses a Cushioning Structure to be used as a packing material to protect packaged goods. The cushioning structure comprises a sheet of material having a plurality of cell structures bonded and sealed thereto. The cell structures are in fluid communication with one another but overall are sealed from the ambient surroundings. Restricted air flow between the cells provides the structure with its cushioning properties.

SUMMARY OF THE INVENTION

The present invention provides a modular supporting structure for positioning and supporting a product within an outer packing container such as a cardboard box. The modular supporting structure of the present invention is made up of a plurality of modules. These modules are separately inflatable one from the other. The modules may be formed as one continuous piece of material, in which case inflation of the module occurs during the blow molding manufacturing process. Alternatively, the module may include a removable cap that is used to provide access to the interior of the module for purposes of inflation and deflation. For purposes of packing, shipping and storing the modules per se, the modules are often deflated to a relatively uninflated reduced size—as compared to their full blow molded size. The modules are then kept relatively uninflated until they are ready to be used. Inflation of the modules is typically done shortly before the modules are in place within the packing container.

The modules are preferably made of polyethylene plastic and are blow moulded to a finished shape. The modules can also be made of other plastic resins such as polypropylene and rubber. The material is flexible, however, and the module can be collapsed to a fairly flat configuration. When the module is inflated, it takes on its full size and shape. The shape and thickness of the module are predetermined by the size and shape of the product that is being packed and the size and shape of the outer packing container. The overall size of each module can vary for any given product and outer packing container, depending on how much of the product is to be in direct contact with the modules.

The modules must of course interconnect one with another in order to form a modular supporting structure. This interconnection is accomplished by means of a connecting portion that is typically in the form of a flange. Preferably, the flange contains a pair of protruding locking members and at least a pair of co-operating openings therein. The locking members of one flange are received and retained by the cooperating openings of a flange of an adjacent module, thus forming a snap-type interconnecting means.

It is also possible to have an interconnecting member that spans between the modules of the modular supporting structure, thereby interconnecting the modules one to another without the modules actually contacting one another.

The modules of the present invention are composed of a plurality of compartments that are interconnected by a restrictive air passage that limits the passage of air between the compartments, thus providing for a cushioning effect through the damping of air flow between the compartments. The inclusion of a restrictive air passage is not necessary; however, it does improve the effectiveness of the cushioning of the modular supporting structure.

A modular supporting structure for positioning and supporting a product within an outer packing container, wherein the product to be supported has predetermined external dimensions and the outer packing container forms a chamber of predetermined internal dimensions, is disclosed. The supporting structure is such that, at least when in use in combination with the product and the outer packing container, the supporting structure comprises a plurality of modules, each module in turn comprising an at least partially inflated air bladder, and a connecting portion that is attached to the air bladder. The air bladder has a first compartment for receiving and retaining the air, an exterior surface that is generally shaped to fit within a portion of the outer packing container and to make contact therewith, and an inwardly directed receiving surface that is generally adapted to receive a portion of the product. When the modules are connected one to another, a product receiving socket is formed by the combination of the inwardly directed surfaces of the plurality of modules. The product receiving socket is shaped to fit the predetermined external dimensions of the product, and the exterior surface of the air bladder are generally shaped to fit the predetermined internal dimensions of the packing container.

BRIEF DESCRIPTION OF THE DRAWINGS

Embodiments of this invention will now be described by way of example in association with the accompanying drawings in which:

FIG. 1 is an isometric view of the modular supporting structure of the present invention comprising four individual modules;

FIG. 2 is an isometric view similar to FIG. 1 but of a single individual module;

FIG. 3 is a top view of the module of FIG. 2;

FIG. 4 is a sectional side view on line 4—4 of the module of FIG. 3;

FIG. 5 is an end view of the module of FIG. 2;

FIG. 6 is an enlarged scale view on line 6—6 of FIG. 3;

DETAILED DESCRIPTION OF THE PREFERRED EMBODIMENTS

Figure 7:
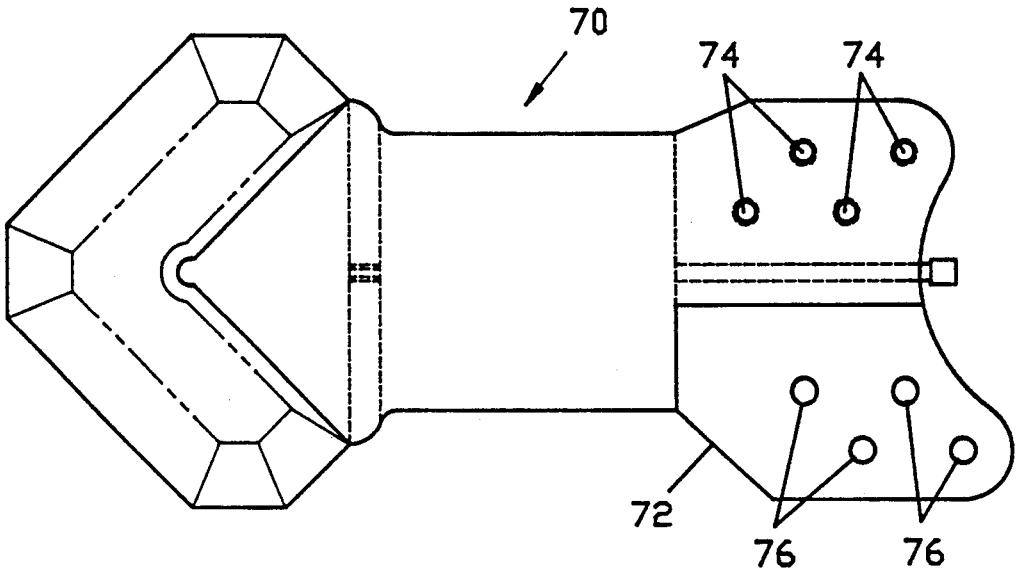
FIG. 7 is a top view of an alternative embodiment of the modular supporting structure of the present invention and shows an individual module.

Reference will now be made to FIG. 1, which shows the modular supporting structure 20 of the present invention in a constructed form, and comprised of four modules 22. In this preferred embodiment, each of the modules 22 is identical one to another. The resulting modular supporting structure is essentially a cruciform formation with a square product receiving socket 24—shown in dashed outline—formed by the relative positions of the four modules. Interconnection of the modules into a modular supporting structure and subsequent functioning of the modular supporting structure will be discussed in greater detail subsequently.

Reference will now be made to FIGS. 2, 3, and 4, which show a single module 22. The module 22 comprises a first compartment 30, a second compartment 32, and a flange 34. The first and second compartments together form an air bladder that is inflated. The preferred and most often used inflation medium is air. Other inflation media such as sulphur hexafluoride may also be used, if desired.

The first compartment 30 has a first exterior surface 40 that includes three separate outer faces. These three separate outer faces contact the packing container in one corner thereof with each of the three separate outer faces contacting a separate inner face—either the top, bottom or one of the sides—of the packing container. The second compartment 32 also has an exterior surface 42 at the bottom thereof for contacting a portion of one inner face of the packing container.

The first and second compartments 30, 32 together also have an inwardly directed surface 44, which is comprised of three separate portions. In the preferred embodiment, these three separate portions are at right angles to one another and form a corner shape that is adapted to receive a similarly shaped corner of a product. There is also an concavely shaped elongated recess 46 in the first compartment 30. This recess 46 receives a portion of one of the three corners—and the vertex of these three corners of the product being supported by the modular supporting structure 20. The corner and vertex are thereby precluded from cutting into the first compartment 30.

As can best be seen in FIG. 4, the first compartment 30 and the second compartment 32 are connected so as to be in fluid communication with one another by a virtue of restrictive air passage 48. The restrictive air passage 48 allows the first and second compartments 30, 32 to be in limited fluid communication with one another by restricting the amount of air that can pass from one compartment to another over a given period of time. The purpose for the two compartments being in fluid communication with one another in this restricted manner is to permit either compartment to deflate slightly if it experiences a sudden heavier load on it or sudden impact force on it, thus providing a damping effect. The diameter of the passage 48 is chosen so as to allow air to pass between the compartments 30, 32 quickly enough to allow either compartment to deform somewhat in the event of a sudden impact or increase in weight on it, but not so quickly as to allow either compartment to virtually collapse, thereby providing insufficient cushioning.

Alternatively, a two-way valve or two counterfacing one-way valves could conceivably be used to control the airflow between the first and second compartments 30, 32.

The first and second compartments 30, 32 are inflated through an inflation tube 50 which is in fluid communication with the second compartment 32 and is also selectably in fluid communication with the exterior of the module 22 at its end 52. A cap 54 is placed over the end 52 of the inflation tube 50 to preclude air within the first and second compartments 30, 32 from escaping through inflation tube 50. The cap 54 is also used to allow the air bladder to be deflated after the module 22 has been manufactured or after it has been used, and also to allow the air bladder to be refilled and resealed. Indeed, the module 22 may be reused several times and may be deflated and re-inflated each time. The module would of course be ultimately recyclable. Alternatively, a valve may be used to control air flow through the end 52 of the inflation tube 50.

It is further contemplated that the inflation tube 50 could have a permanently closed end in the form of a snip-off nipple. A module of this configuration would therefore be formed as one continuous piece of material, in which case inflation of the module occurs during the blow molding process. The module would remain in this fully inflated condition until the snip-off nipple is removed.

The flange 34 extends outwardly from the second compartment 32 and is generally—at least to some degree—in the same plane as the portion of the inwardly directed surface 44 on the second compartment 32. The flange 34 includes a first portion 56 and a second portion 58. The first portion 56 is located slightly above the second portion 58. As can be best seen in FIG. 5, the top surface 60 of the second portion 58 is approximately at the same level as the bottom surface 62 of the first portion 58. There is a pair of protruding locking members 64 that protrude downwardly from the bottom surface 62 of the first portion 56. These locking members 64 are adapted for insertion into cooperating openings 66 in the second portion 58. This combination of locking members 64 and co-operating openings 66 basically constitute a snap type fastener. As can best be seen in FIG. 6, which shows a cutaway view of a single locking member that has been received and retained by a cooperating opening 66, the diameter of the locking member 64 is slightly greater than the diameter of the cooperating opening 66, which causes the locking member 64 to be retained within the cooperating opening 66. When the modules 22 are interconnected one with another, the first portion 56 of one module overlaps the second portion 58 of the adjacent module.

The downwardly protruding locking members 64 on the first portion 56 of flange 34 are inserted into the co-operating openings 66 of the flange 34 of an adjacent module 22, and are retained therein. In this manner, individual modules 22 can be joined one to another in order to form the modular supporting structure as shown in FIG. 1.

Reference is again made to FIG. 1, which shows four modules 22 interconnected with one another. It can be seen that the module marked A has its first portion 56A of the flange 34A overlapped overtop of the second portion 58B of the adjacent module marked B and its second portion 58A overlapped underneath the first portion 56D of the module marked D. Similarly, the module marked B has its first portion 56B of the flange 34B overlapped overtop the second portion 58C of the flange 34C of the module marked C and its second portion 58B overlapped underneath the first portion 56C of the module marked C. Similarly, the flange 34C of the module marked C overlaps with the flanges of the adjacent modules marked B and D and the flange 34D of the module marked D overlaps with the flanges of the adjacent modules marked B and D. In this manner, the four modules are interconnected one with the other in an interleaved manner thus forming the modular supporting structure of the present invention. It can be seen that a square product receiving socket 24 is formed by such interconnection of these four identical modules.

The modular supporting structure of the present invention is commonly used in the following manner. A packing container, typically a cardboard box, is placed ready to receive packing materials and a product therein, with the top of the box being open. A modular supporting structure—typically made up of four modules 22—is placed at the bottom of the box with the product receiving socket 24 facing upwardly. The product to be packed is then placed in to the box and seated in the product receiving socket 24. The modules 22 are of a size such that the product receiving socket is essentially the same size as the particular product being retained therein. Thus, the product is held reasonably snugly. Another modular supporting structure is then placed on top of the product. This second modular supporting structure must of course be oriented with the product receiving socket 24 facing downwardly. The cardboard box can then be closed.

Reference will now be made to FIG. 7 which shows an alternative embodiment, wherein the module 70 has an extended flange 72. The extended flange 72 has two pairs of protruding locking members 74 and also two pairs of cooperating openings 76. Each pair of protruding locking members 74 can be received and retained by either pair of cooperating openings 76. In this manner, the size of the modular supporting structure that is formed from interconnecting four such modules is not limited to just one size.

Figure 8:
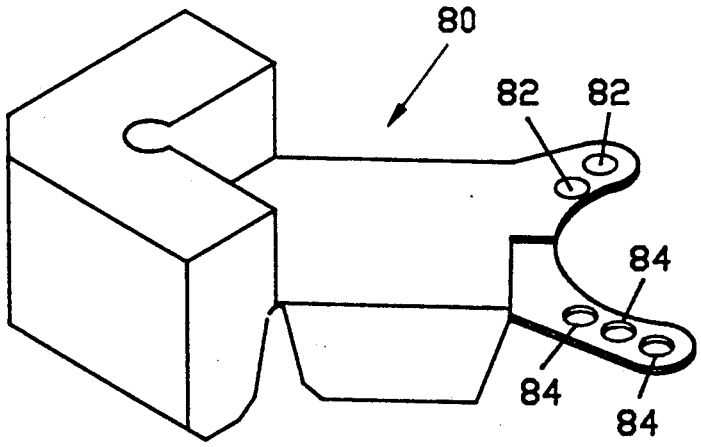
FIG. 8 is an isometric view of an alternative embodiment of the modular supporting structure of the present invention and shows a single individual module.

Reference will now be made to FIG. 8 which shows an alternative embodiment of the present invention, wherein a module 80 has two locking members 82 and three co-operating openings 84. The two locking members 82 can be placed either in the two co-operating openings marked A and B or the two co-operating openings 84 marked B and C. By having this configuration of co-operating openings 84, it is possible to form more than one size of modular supporting structure. Further, it is possible to form a modular supporting structure that has a rectangularly shaped product receiving structure. It is of course also possible to include more than three co-operating openings 84, if desired.

Figure 9:
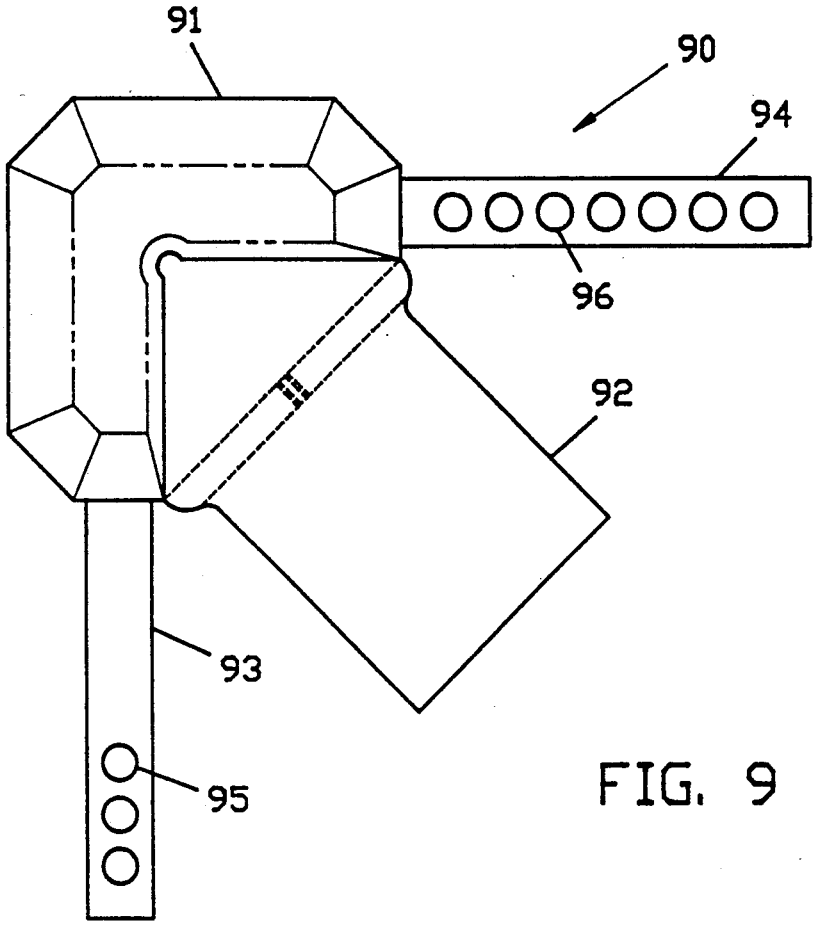
FIG. 9 is a side view of a further alternative of the present invention and shows a single module.

Reference will now be made to FIG. 9, which shows a further alternative embodiment of the invention. In this alternative embodiment there is a module 90 having a first compartment 91 and a second compartment 92 as does the module in the preferred embodiment. Extending outwardly from the first compartment 91 in a first direction is a flange 93 and extending outwardly from the first compartment 91 in a second direction is second flange 94. The first flange 93 has a series of colinearly aligned protruding locking members 95 and the second flange 94 has a plurality of colinearly aligned co-operating openings 96 that are adapted to receive and retain the locking members 95. This embodiment of module can be used to form either square or rectangular modular supporting structures with the number of co-operating openings 96 determining how many sizes of modular supporting structure can be formed. Either square or rectangular modular supporting structures can be formed. It is also possible to have the first and second flanges 93, 94 extending outwardly from the second compartment 92 in a similar manner to that described above.

Figure 10:
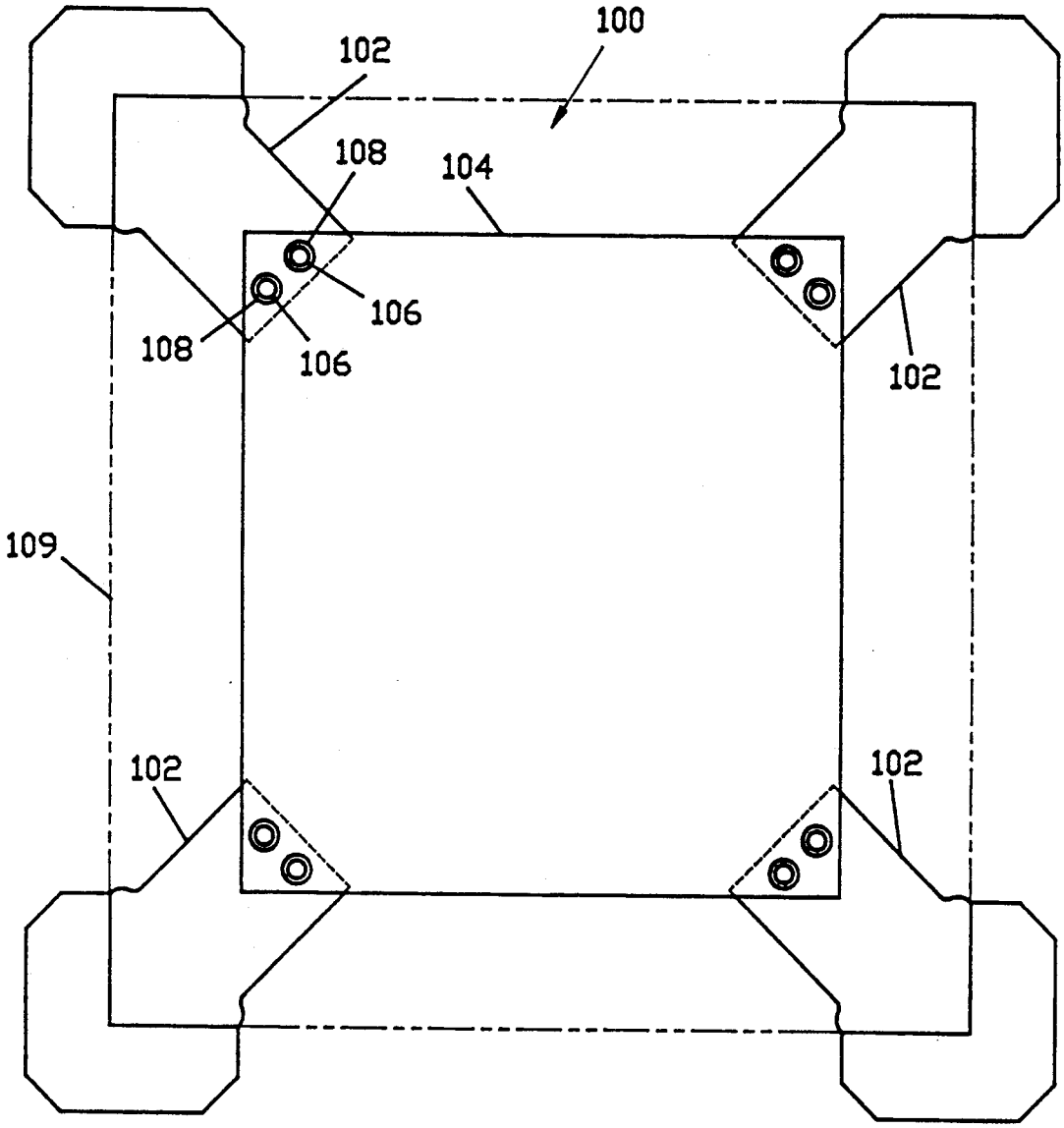
FIG. 10 is a top view of an alternative embodiment of the modular supporting structure of the present invention.

Reference will now be made to FIG. 10, which shows a still alternative embodiment of the present invention. In this alternative embodiment a modular supporting structure 100 has been formed from four modules 102, which are interconnected by an interconnecting member 104. The interconnecting member 104 is preferably a piece of plastic, either solid or with openings cut in it for weight reduction purposes, that spans between the four modules 102. The modules 102 connect to the interconnecting member 104 in a manner similar to that disclosed above. The module 102 has protruding locking members 106 that protrude upwardly from the module 102. The interconnecting member 104 has a pair of cooperating openings 108 that receive and retain the protruding locking members 106 of the module 102. In this manner, each module is fastened in fixed relation to the interconnecting member 104 which thereby keeps all four of the modules 102 in a fixed relation to one another. Further, the modules 102 form a product receiving socket 109 that is of a particular size and shape as determined by the size and shape of the interconnecting member 104. Advantageous features of this particular alternative embodiment are that virtually any size and shape of product can be accommodated by using the appropriate size and shape of interconnecting member 104. Further, only one size and shape of module 102 is specifically required to form any size of square or rectangular product receiving sockets 109.

Figure 11:
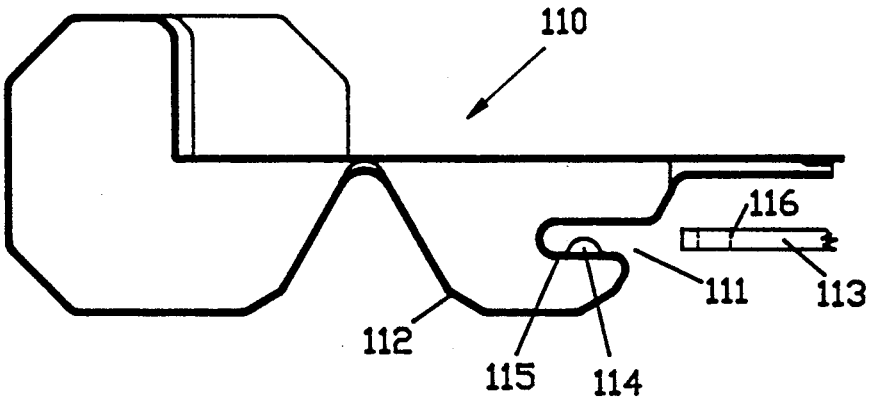
FIG. 11 is a top view of a further alternative embodiment of the modular supporting structure of the present invention.

Reference will now be made to FIG. 11, which shows yet another alternative embodiment of the present invention. In this alternative embodiment, the module 110 has a slot 111 horizontally disposed in the second compartment 112. An interconnecting member 113 is slid into the slot 111. A protrusion 114 on the bottom surface 115 of the slot 111 enters an aperture 116 in the interconnecting member 113. The interconnecting member 113 is retained in the slot 111 by the protrusion 114 in the aperture 116.

In another alternative embodiment, it is contemplated that the inwardly directed surface of a module could be curved in order to accommodate a round product, and the interconnecting member could be any shape as required.

In yet another alternative embodiment, it is contemplated that there could be more than two compartments, as necessary, with the various compartments being in restricted fluid communication with one another.

Other modifications and alterations may be used in the design and manufacture of the modular supporting structure of the present invention without departing from the spirit and scope of the accompanying claims.

What is claimed is:

1. A modular supporting structure for positioning and supporting a product within an outer packing container, wherein said product to be supported has predetermined external dimensions, and said outer packing container forms a chamber of predetermined internal dimensions; and wherein said supporting structure is such that, at least when in use in combination with said product and said outer packing container, said supporting structure comprises:

a plurality of modules interconnected one to another, each module in turn comprising an at least partially inflated bladder, and a connecting portion that is attached to said bladder of each respective module;

wherein each of said bladders has a first compartment for receiving and retaining an inflating gas;

wherein each module has an exterior surface that is generally shaped and sized so as to correspond to a portion of said predetermined internal dimensions of a said outer packing container;

wherein each of said modules has an inwardly directed receiving surface that is generally shaped and sized so as to correspond to a portion of said predetermined external dimensions of a said product;

said plurality of modules being separably connected one to another by way of said connecting portions so as to form said modular supporting structure, said modular supporting structure having a predetermined shape product-receiving socket defined by said inwardly directed surfaces of said plurality of modules; and wherein said modules are maintained physically separated from each other by said connecting portions being interconnected, whereby said modules act independently of each other in terms of the load supported by each.

2. The modular supporting structure of claim 1, further comprising a second compartment in each of said bladders.

3. The modular supporting structure of claim 2, wherein said first and second compartments are connected by a restrictive air passage that limits the rate of flow of air between said first and second compartments.

4. The modular supporting structure of claim 1, wherein said modules in said modular supporting structure are substantially identical one to another.

5. The modular supporting structure of claim 1, wherein each of said connecting portions includes a flange having a protruding locking member and a cooperating opening for receiving a locking member, wherein said locking member is received and retained by a cooperating opening in an adjacent module.

6. The modular supporting structure of claim 5, wherein each of said flanges is generally horizontally oriented.

7. The modular supporting structure of claim 5, wherein said modules connect together in an interleaved manner.

8. The modular supporting structure of claim 5, wherein there are two locking members and two co-operating openings.

9. The modular supporting structure of claim 5, wherein there are three co-operating openings.

10. The modular supporting structure of claim 5, further including an interconnecting member that is connected to each of said connecting portions and spans between and connects said modules.

11. The modular supporting structure of claim 1, wherein said modular supporting structure comprises four modules connected together in the shape of a cruciform.

12. The modular supporting structure of claim 1, wherein said modules include means to allow the modules to connect together in a plurality of positions with respect to one another so as to allow said modules to form modular supporting structures of various sizes.

13. The modular supporting structure of claim 1, wherein each of said modules has a deflation cap to allow for inflation and deflation for each respective bladder.

14. The modular supporting structure of claim 1, wherein each of said modules has a snip-off nipple to allow for deflation of each respective bladder.

15. The modular supporting structure of claim 1, further including an interconnecting member that is connected to said connecting portion of each of said modules and spans between and connects said modules.

16. The modular supporting structure of claim 15, wherein each connecting portion is an integral part of said inwardly directed surface of its respective module.

17. The modular supporting structure of claim 15, wherein each of said modules has a slot therein, with each slot being adapted to receive a portion of said interconnecting member, and wherein said connecting portion is an integral part of each of said modules.

* * * * *